US006155913A

United States Patent [19]

Quek

[11] Patent Number: 6,155,913

[45] Date of Patent: Dec. 5, 2000

[54] DOUBLE POLISHING HEAD

[75] Inventor: Ser Wee Quek, Singapore, Singapore

[73] Assignees: Chartered Semiconductor Manuf. Ltd.; Silicon Manufacturing Partners, Pte, Ltd., both of Singapore, Singapore

[21] Appl. No.: 09/290,920

[22] Filed: Apr. 12, 1999

[51] Int. Cl.[7] ..... B24B 1/00

[52] U.S. Cl. ..... 451/57; 451/63; 451/287

[58] Field of Search ..... 451/41, 63, 259, 451/268, 269, 270, 287, 288, 289, 290, 65, 57, 285, 66

[56] References Cited

U.S. PATENT DOCUMENTS

| | | | |
|---|---|---|---|
| 4,726,150 | 2/1988 | Nishio et al. | 451/271 |
| 5,230,184 | 7/1993 | Bukhman | 51/283 R |
| 5,575,707 | 11/1996 | Talieh et al. | 451/173 |
| 5,690,542 | 11/1997 | Ikemoto | 451/271 |
| 5,733,175 | 3/1998 | Leach | 451/270 |
| 5,800,253 | 9/1998 | Ikemoto | 451/271 |
| 5,816,891 | 10/1998 | Woo | 451/6 |

FOREIGN PATENT DOCUMENTS

| | | | |
|---|---|---|---|
| 359110539 | 6/1984 | Japan | 451/269 |
| 361168462 | 7/1986 | Japan | 451/63 |

*Primary Examiner*—Derris H. Banks
*Attorney, Agent, or Firm*—George O. Saile; Rosemary L. S. Pike

[57] ABSTRACT

Double or multiple unit polishing heads are used thereby negating the negative effects that irregularities in the surface of the polishing pad have on the polishing results obtained. Adjacent double or multiple unit polishing heads rotate in opposite directions thereby eliminating the effects of microscopic directions in the surface of the polishing pads.

40 Claims, 5 Drawing Sheets

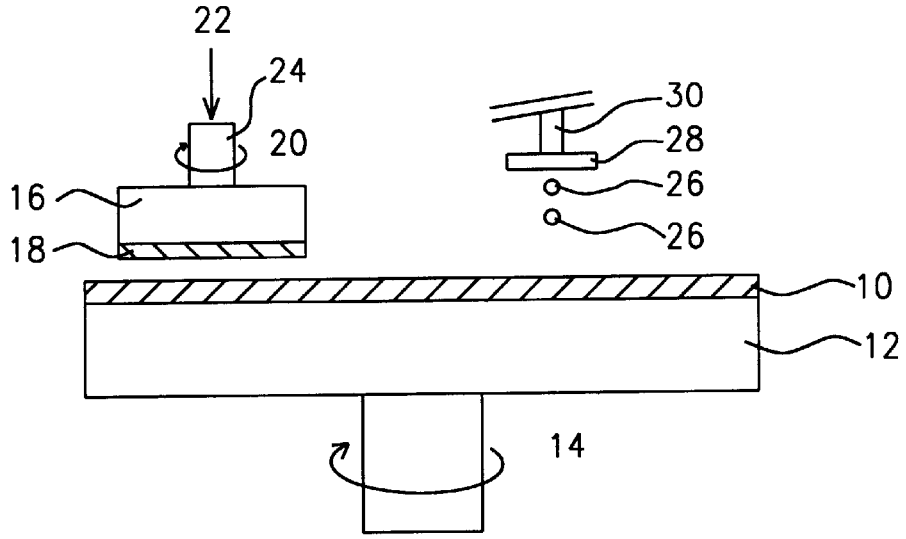
FIG. 1 – Prior Art
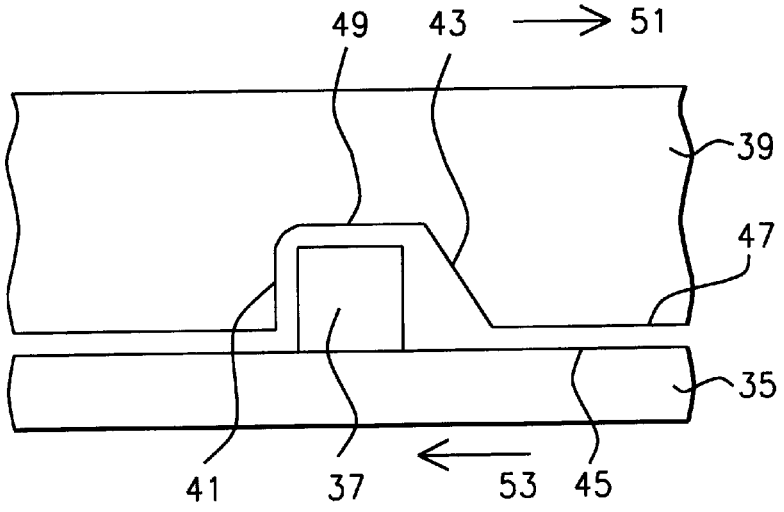
FIG. 2

DOUBLE POLISHING HEAD

BACKGROUND OF THE INVENTION (1) Field of the Invention

The present invention relates to the field of Chemical Mechanical Polishing (CMP) of semiconductor surfaces. The present invention specifically relates to methods and apparatus for chemical mechanical polishing of substrates, such as semiconductor substrates, on a rotating polishing pad in the presence of chemically and/or physically abrasive slurry.

(2) Description of the Prior Art

The method of Chemical Mechanical Polishing (CMP) is a widely accepted method for polishing surfaces, such as semiconductor substrates, to a high degree of planarity and uniformity. The CMP process can be applied to planarize semiconductor wafers before semiconductor circuitry is created within the wafers while the same process can also be used to remove surface irregularities or features of high elevation that have been created during the fabrication of the microelectronic circuitry on the semiconductor wafer. Typically a large polishing pad is used during chemical mechanical polishing, this polishing pad is located on a rotating platen. The surface that needs to be polished is positioned against the polishing pad. Both the polishing pad and the surface that needs to be polished are rotated, typically the two surfaces rotate in opposite directions. Chemical slurry, which may include abrasive materials, is maintained on the polishing pad to modify the polishing characteristics of the polishing pad in order to enhance the polishing of the substrate.

In the conventional approach, the wafer is held in a circular carrier, which rotates. The polishing pads are mounted on a polishing platen which has a flat surface and which rotates. The rotating wafer is brought into physical contact with the rotating polishing pad; this action constitutes the Chemical Mechanical Polishing process. Slurry is dispensed onto the polishing pad typically using a peristaltic pump. The excess slurry typically goes to a drain, which means that the conventional CMP process has an open loop slurry flow and therefore uses and dispenses with an excessive amount of slurry that adds significantly to the processing cost. There also is no method for exactly controlling slurry flow.

Since the wafer to be polished, which has a flat surface, and the polishing pad, which in the conventional approach is mounted on a flat polishing table, are both rotating, there exists a velocity differential across the surface of the wafer during the polishing operation. This velocity differential has a negative impact on wafer polishing uniformity and planarity across the die and across the wafer. This limits the application of the conventional CMP approach especially in Shallow Trench Applications, copper damascene, etc., which are involved in sub-quarter micron technology modes.

The use of chemical mechanical polishing to planarize semiconductor substrates has not met with universal acceptance, particularly where the process is used to remove high elevation features created during the fabrication of microelectronic circuitry on the substrate. One primary problem which has limited the used of chemical mechanical polishing in the semiconductor industry is the limited ability to predict, much less control, the rate and uniformity at which the process will remove material from the substrate. As a result, CMP is labor intensive process because the thickness and uniformity of the substrate must be constantly monitored to prevent over-polishing or inconsistent polishing of the substrate surface.

Specifically, applying the CMP process to Intra-Level Dielectric (ILD) and Inter Metal Dielectric (IMD) that are used for the manufacturing of semiconductor wafers, surface imperfections (micro-scratch) typically present a problem. Imperfections caused by micro-scratches in the ILD and IMD can range from 100 to 1000 EA for 200 mm. wafers, where an imperfection typically has a depth from 500 to 900 Å and a width of from 1000 to 3000 Å. As part of the polishing process of the ILD and IMD, a tungsten film is deposited; the surface imperfections will be filled with tungsten during this deposition. For devices within the semiconductor wafer with a dimension of 0.35 um. or larger, an etching process is used where the tungsten that has entered the imperfections within the wafer surface can be removed. For the larger size devices within the semiconductor wafer there is therefore no negative impact on the yield of these devices. For device sizes within the semiconductor wafer of 0.25 um or less, the indicated procedure of etching the tungsten layer is no longer effective. This results in relative large imperfections within the surface of the wafer, large with respect to the size of the semiconductor devices. These imperfections will cause shorts between the metal lines within the devices while the imperfections also have a severe negative impact on device yield and device reliability.

The profile of the polishing pad plays an important role in determining good overall polishing results. The polishing pad can, for instance, be profiled thick at the inner diameter of the polishing pad as compared to the outer diameter of the polishing pad and visa versa. The profile of the polishing pad is typically achieved by trial and error and by adjusting the position of a diamond dresser (see following paragraph). This method of profiling the polishing pad is destructive, time consuming and causes the loss of the polishing pad. Since this measure of the polishing pad profile can only be performed at the end of the useful life of the polishing pad, the wrong profile can only be detected after the polishing pad has served its useful life.

The polishing process is carried out until the surface of the wafer is ground to a highly planar state. During the polishing process, both the wafer surface and the polishing pad become abraded. After numerous wafers have been polished, the polishing pad becomes worn to the point where the efficiency of the polishing process is diminished and the rate of removal of material from the wafer surface is significantly decreased. It is usually at this point that the polishing pad is treated and restored to its initial state so that a high rate of uniform polishing can once again be obtained.

FIG. 1 shows a Prior Art CMP apparatus. A polishing pad 10 is affixed to a circular polishing table 12 that rotates in a direction indicated by arrow 14 at a rate in the order of 1 to 150 RPM. A wafer carrier 16 is used to hold wafer 18 face down against the polishing pad 10. The wafer 18 is held in place by applying a vacuum to the backside of the wafer (not shown). The wafer 18 can also be attached to the wafer carrier 16 by the application of a substrate attachment film (not shown) to the lower surface of the wafer carrier 16. The wafer carrier 16 also rotates as indicated by arrow 20, usually in the same direction as the polishing table 12, at a rate on the order of 1 to 150 RPM. Due to the rotation of the polishing table 12, the wafer 18 traverses a circular polishing path over the polishing pad 10. A force 22 is also applied in the downward vertical direction against wafer 18 and presses the wafer 18 against the polishing pad 10 as it is being polished. The force 22 is typically in the order of 0 to 15 pounds per square inch and is applied by means of a shaft 24 that is attached to the back of wafer carrier 16.

Accordingly, the subject surface (that is the lower surface) of the substrate 18 is polished by the combination of a chemical polishing action of alkali contained in the polishing agent or slurry 26 and a mechanical polishing action by silica contained in the polishing slurry 26. Slurry 26 is provided to the surface of the polishing pad 10 by means of the slurry distribution head 28, slurry supply line 30 is connected to a slurry supply vat (not shown) from where the slurry is provided to the polishing system. The type of slurry used in combination with the method in which the slurry is delivered to the polishing pad have a considerable influence on the effectiveness of the polishing action. Slurry can for instance be delivered by gravity feed or it can be delivered under pressure. Slurry can be of one chemical component or of a mixture of chemical components. It is furthermore of importance to assure that the slurry is evenly distributed over the surface of the polishing pad. The angle and force under which the slurry impacts the surface of the polishing pad are therefore of importance in the design of a chemical mechanical polishing apparatus. Further considerations in this design must be the even and uniform polishing action across the entire surface that is being polished in order to assure uniform planarity and thickness of the surface.

Further to be considered is the effect that irregularities of any kind in the surface of the polishing pad have on the final polishing performance and results of the pad. Microscopic analysis of the surface profile of the polishing pad will reveal unsymmetrical or irregular surface cavities or indentations. The effect of this lack of symmetry of these surface indentures is that the polishing action provided by the polishing pad is dependent on the direction in which the polishing pad crosses the surface that is being polished. This relative direction of motion between the polishing pad and the surface that is being polished reverses with great frequency and unpredictability due to the rotating motion of both the polishing pad and the surface that is be in g polished.

FIG. 2 further illustrates this point. Wafer 35 has a surface 45 that is being polished, polishing pad 39 has a polishing surface 47. The irregularities 37 (in the surface of the wafer) and 49 (in the surface of the polishing pad) are, for purposes of explanation, highly magnified. In the example shown, irregularity 37 (in the surface of the wafer) will strikes edge 43 of the polishing pad indentation 49 in view of the relative motions 51 (of the polishing pad 39) and 53 (of the substrate). It is clear from FIG. 2 that, if the directions of the relative motions 51 and 53 are reversed, the irregularity 37 will strikes edge 41 of the polishing pad indentation 49. Since the angle or incline of edges 41 and 43 are not identical, it follows that the polishing action provided by the polishing pad 39 during the CMP process is not universal. The invention teaches a method that eliminates this irregularity in polishing pad impact during the process of chemical mechanical polishing.

The above impact of irregularities in the surface of the polishing pad is further emphasized by the fact that, using conventional polishing apparatus, the center of the substrate is at a fixed distance from the center of the polishing pad. FIG. 3 shows a plan view of the polishing pad 55 (rotating in direction 63) whereupon a wafer 57 (rotating in direction 65) is being polished. The ratio r1/r2 is fixed and determined by the diameters of the wafer and the polishing pad. This fixed ratio increases the probability that the same irregularities in the surface of the polishing pad (for instance irregularity 59) will come into contact with the same surface unevenness in the surface that is being polished (for instance unevenness 61) whereby this contact is made under the same relative positioning of irregularity with respect to unevenness. This further amplifies the previously highlighted negative impact on polishing effectiveness and quality.

A typical CMP process involves the use of a polishing pad made from a synthetic fabric and polishing slurry which includes pH-balanced chemicals, such as sodium hydroxide, and silicon dioxide particles.

Abrasive interaction between the wafer and the polishing pad is created by the motion of the wafer against the polishing pad. The pH of the polishing slurry controls the chemical reactions, e.g. the oxidation of the chemicals that comprise an insulating layer of the wafer. The size of the silicon dioxide particles controls the physical abrasion of surface of the wafer.

The polishing pad is typically fabricated from a polyurethane (such as non-fibrous polyurethane, cellular polyurethane or molded polyurethane) and/or a polyester-based material. Pads can for instance be specified as being made of a microporous blown polyurethane material having a planar surface and a Shore D hardness of greater than 35 (a hard pad).

U.S. Pat. No. 5,230,184 (Bukhman) shows a distributed polish head assembly that has a plurality of polish pads.

U.S. Pat. No. 5,575,707 (Talieh et al.) teaches a polish pad cluster for polishing a wafer.

U.S. Pat. No. 5,816,891 (Woo) shows a CMP machine with multiple polish pad and carriers.

SUMMARY OF THE INVENTION

It is the primary objective of the present invention to provide a polishing device that assures uniformity and planarity of surface of the substrate that is polished.

It is another objective of the invention to provide a chemical mechanical polishing apparatus that has uniform polishing rates across the surface of the die and the wafer.

It is another objective of the present invention to improve semiconductor wafer throughput during wafer polishing using the CMP process.

It is another objective of the present invention to enable reduction of semiconductor device dimensions.

Yet another objective of the present invention is to enable reduction of semiconductor device dimensions to the quarter-micro range.

In accordance with the objectives of the invention, a new method of performing chemical mechanical polishing is achieved.

The invention teaches the use of a double or multiple polishing head thereby negating the negative effects that irregularities in the surface of the polishing pad have on the polishing results obtained. The double or multiple polishing heads of the new polishing apparatus assure that the effects of microscopic irregularities in the surface of the polishing pad are cancelled out during the polishing process thereby assuring better planarization of the surface that is being polished.

BRIEF DESCRIPTION OF THE DRAWINGS

FIG. 1 shows a Prior Art substrate polishing apparatus.

FIG. 2 shows a cross section of surface irregularities.

DESCRIPTION OF THE PREFERRED EMBODIMENT

Figure 3:
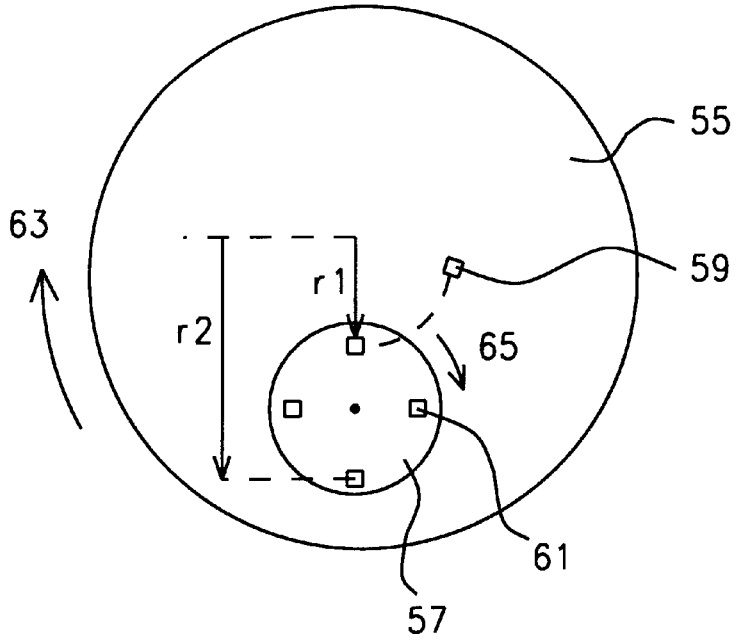
FIG. 3 shows a plan view Prior Art polishing pad with a substrate.

Referring now specifically to FIG. 4 there is shown a top view of the double polishing head of the invention. The double polishing heads contains two polishing heads 70 and 72. The center 78 of the wafer carrier 74 is positioned on the line 82 that connects the centers 76 and 80 of the two polishing heads 70 and 72 and will be centered at equal distance from the two centers 76 and 80 of the polishing heads 70 and 72. The position of the center 78 of the wafer carrier 74 does however not have to be stationary with respect to centers 76 and 80 but may oscillate in the direction of the line 82 that connects the centers of the two polishing heads 70 and 72. Wafer carrier 74 rotational direction is indicated as 84, this direction can however also be reversed from the direction shown. Wafer carrier 74 can rotate either clock-wise or counter clock-wise. The rotational direction 86 of polishing pad 70 is the same as the rotational direction 84 of the wafer carrier 74, the rotational direction 88 of polishing pad 72 is the opposite of the rotational direction 84 of the wafer carrier 74. The motion 90 of oscillation of the wafer carrier assures that the center of the wafer is polished. This direction of oscillation 90 is parallel to the line 82 that connects the centers of the two polishing heads 70 and 72. The three rotational directions 84, 86 and 88 can be as indicated in FIG. 4 or all of these directions can be reversed if the direction 84 of the rotation of the wafer carrier is reversed.

It must further be noted that the rotational speed of polishing pad 72, for the rotational directions that have been indicated in FIG. 4, is equivalent to the rotational speed of polishing pad 70 plus 2 times the rotational speed of the substrate 74. That this is required becomes obvious in considering the relative direction between each polishing pad and the substrate. Where these directions of rotation are opposite, the polishing action is determined by the speed difference between the polishing pad and the substrate, among other factors. Where these directions of rotation are the same, the polishing action has to be kept at the same level by increasing the speed of the polishing pad by the speed of the substrate in order to assure that the relative speed between the polishing pad and the substrate is the same (as the speed in the case where the polishing pad and the substrate rotate in opposite directions).

This interrelation between the rotational speed of the wafer carrier and the double polishing heads remains valid for the application of the double polishing head where the rotation of the substrate is opposite to the direction of rotation as shown in FIG. 4. That is: rotational speed for the polishing head that turns in a direction opposite to the direction of the wafer is equal to the rotational speed of the polishing head that turns in the same direction as the wafer plus 2 times the rotational speed of the wafer.

Figure 4A:
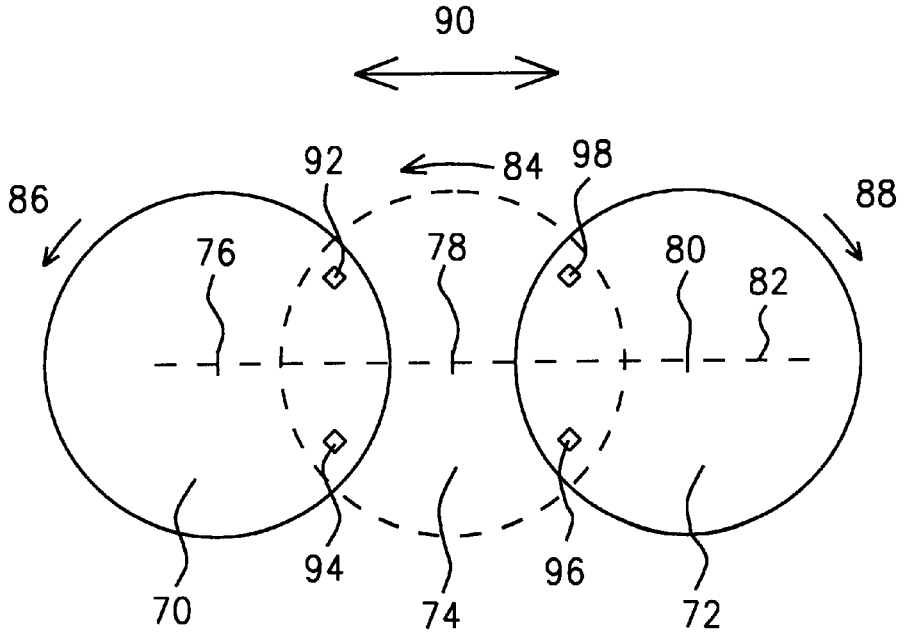
FIGS. 4 (*a–e*) show plan views of the double polishing head of the invention.
Figure 4B:
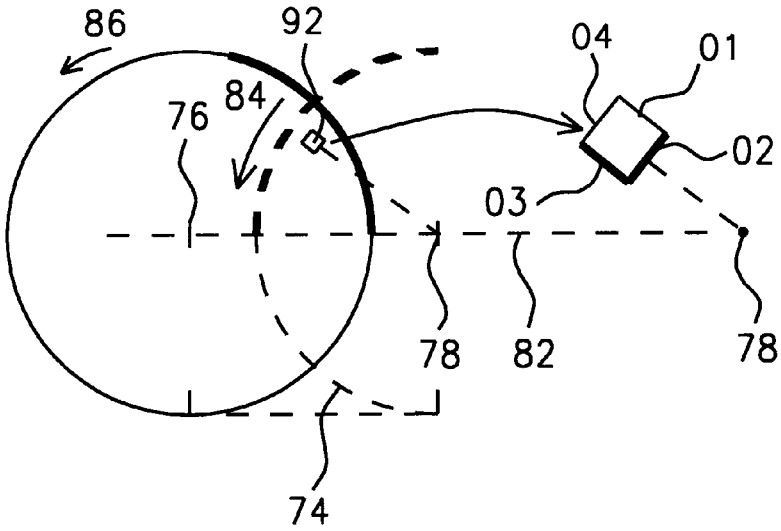

It is of interest to trace the polishing action that a surface irregularity is submitted to when being polished by the double polishing head. This substrate irregularity has been indicated in FIG. 4*a* in four different locations while the substrate 74 rotates in direction 84 around its center 78, these locations are 92, 94, 96 and 98. For all four locations the action of the polishing pads 70 and 72 on one and the same surface irregularity of the substrate 74 is being considered. This surface irregularity is, for purposes of clarity, again indicated under FIG. 4*b*, the purpose of FIG. 4*b* is to identify the four sides of the surface irregularity. These sides are as shown and are highlighted as sides 01, 02, 03 and 04. From the relative direction of rotation 86 of the polishing pad 70 with respect to the direction of rotation 84 of the substrate 74, it is clear that for position 92 (FIG. 4*a*) of the substrate surface irregularity, the sides 02 and 03 are the leading edge sides in the polishing impact on the wafer surface irregularity.

Figure 4C:
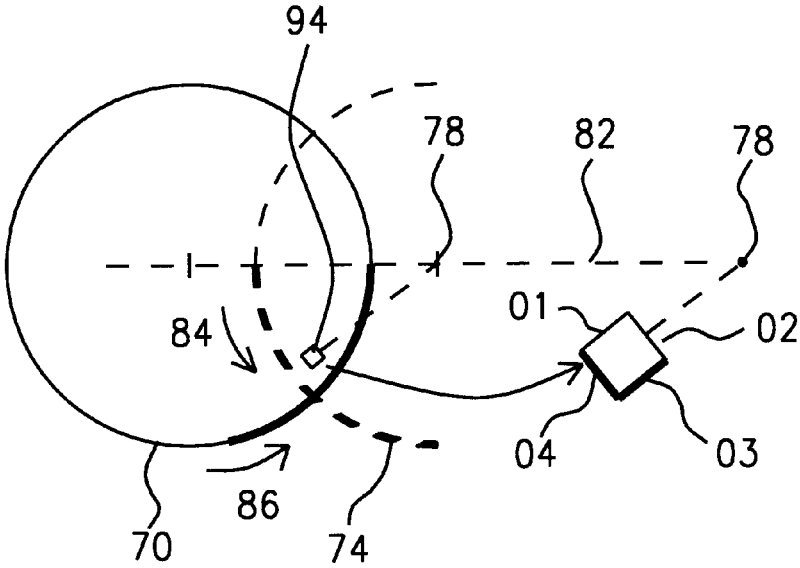

FIG. 4*c* shows the same rotational aspects, this time for location 94 (FIG. 4*a*) of the substrate surface irregularity. For ease of understanding it should be emphasized that the surface irregularity maintains the same position with respect to the center 78 of the substrate, that is side 02 is always closest to this center 78, by counting in clock-wise direction the numbers assigned to the sides of the irregularity increase to where they revert back to 01. For location 94 shown in FIG. 4*c* it is clear that the leading edge of the substrate surface irregularity is 03 and 04.

Figure 4D:
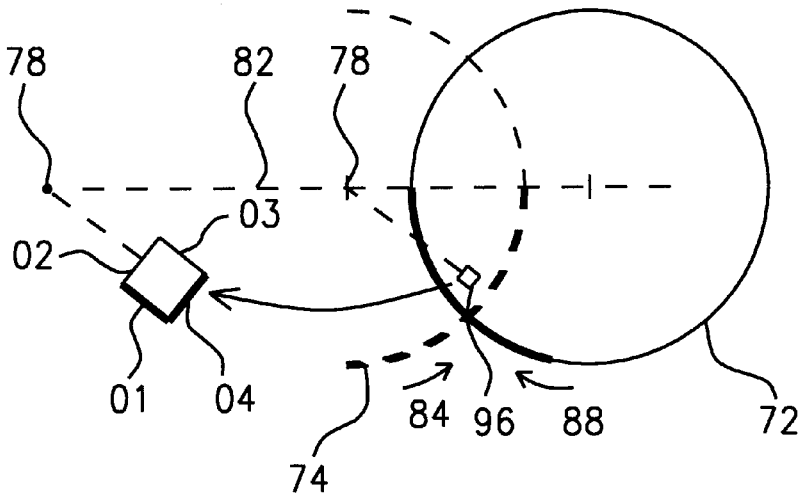

Following the same pattern of reasoning, FIG. 4*d* shows that sides 02 and 04 are the leading edge sides for position 96 (FIG. 4*a*) of the substrate irregularity. For FIG. 4*d* the rotational direction 84 of substrate 74 is indicated. Also indicated is rotational direction 88 for polishing pad 72.

Figure 4E:
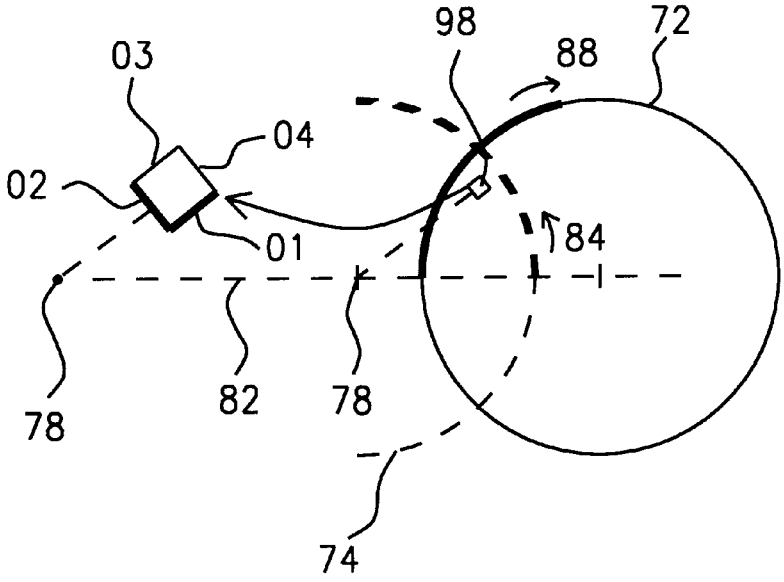

FIG. 4*e* shows that sides 02 and 03 are the leading edge sides for position 98 (FIG. 4*a*) of the substrate irregularity.

For FIG. 4*e* the rotational direction 84 of substrate 74 is indicated. Also indicated is rotational direction 88 for polishing pad 72.

The above findings can be summarized as follows, referring to FIG. 4*a*:

| Irregularity | | | | |
|---|---|---|---|---|
| Location | 92 | 94 | 96 | 98 |
| Leading edge | 02, 03 | 03, 04 | 04, 01 | 01, 02 |

It is of interest to note that in rotating, for instance from location 92 to location 94, the sides that form the leading edge change from 02, 03 to 03, 04. Midway between this transition, side 03 is the only side that forms the leading edge. This can be visualized as if the polishing action on the irregularity in the surface of the wafer takes place by polishing every side of the irregularity in succession while the polishing action follows the periphery of the irregularity.

It is clear that, from summarizing the number of times that the respective sides of the substrate irregularity find themselves in the leading edge position while passing through the four positions 92, 94, 96 and 98 (two times for each of the four sides 01 through 04), the substrate irregularity is polished around its entire periphery by the combined polishing action of the two polishing heads. This aspect of the double polishing head apparatus is of key importance in understanding the effectiveness of the polishing operation when using this apparatus.

For the explanation of the above phenomenon, four points of observation or positions were selected. The four points of observation can be further detailed into multiple points of observation. Such further detail would, although adding significantly to the complexity of the explanation, not provide any additional insight and would serve only to further amplify the conclusions reached with the four selected points.

Figure 5:
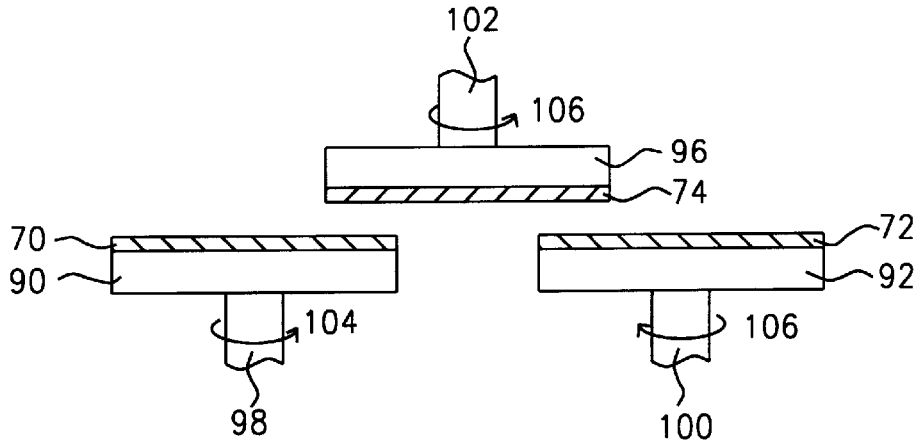
FIG. 5 shows a cross section view of the double polishing heads of the invention.

FIG. 5 shows a cross section of the double head polishing apparatus. Polishing pad 70 is mounted on top of the polishing table 90; this table is rotated by means of axis 98 in the direction of rotation 104. Polishing pad 72 is mounted on top of the polishing table 92; this table is rotated by means of axis 100 in the direction of rotation 106. Substrate 74 is mounted on the substrate carrier 96 and faces down toward the double polishing pads 70 and 72. The substrate carrier 96 is rotated by axis 102 in the direction 106, which is the same direction of rotation as the rotation of substrate 70. Slurry distribution heads (not shown) are mounted above the surface of the polishing pads 70 and 72. The various method that can be applied in distributing slurry across the surface of the polishing pads have been highlighted previously and are not part of the invention.

Figure 6A:
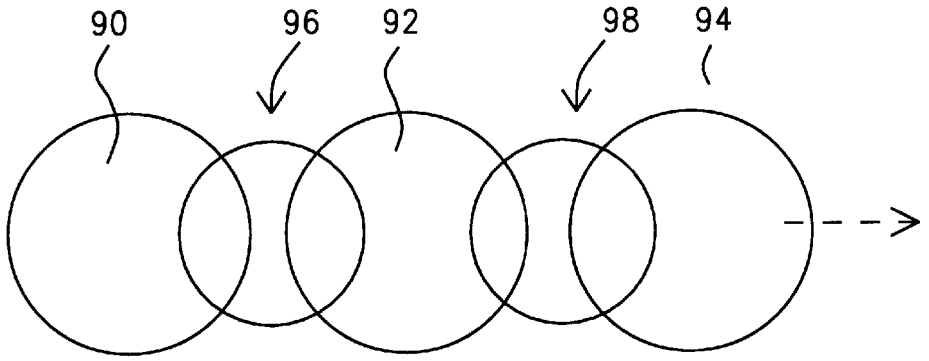
FIGS. 6(*a*&*b*) show cross section views of the multiple polishing heads of the invention.
Figure 6B:
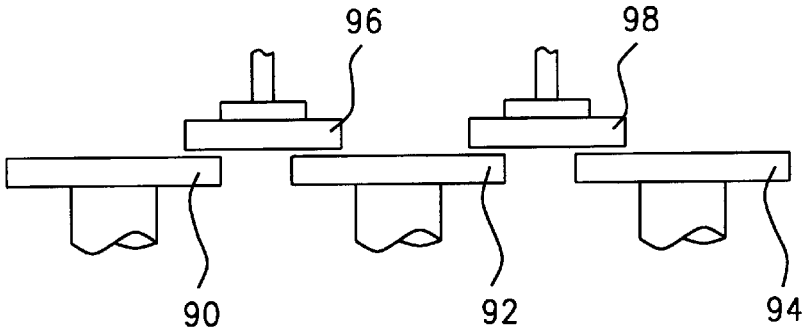

FIG. 6 shows how the concept of the invention can be extended to create a polishing apparatus that contains a multiplicity of polishing heads that are matched with a multiplicity of wafer carriers. The same principles and advantages as described above for a polishing apparatus that contains two polishing heads also apply to a multiple polishing head arrangement. A practical limitation as to the number of polishing heads that can be used is not apparent at this time while considerable advantages of improved planarization and wafer throughput can be achieved by using a multiple polishing head apparatus. The polishing heads in FIG. 6*a* are indicated in planar or top view by the numbers 90, 92 and 94, the wafers that are being polished are numbered 96 and 98. FIG. 6*b* shows a cross section of the same apparatus as the apparatus shown in top view in FIG. 6*a*. It appears at this time that the number of polishing pads can readily be extended to N where N is a whole integer, the number of wafers that can be polished using such an apparatus is N−1.

Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications which fall within the scope of the appended claims and equivalents thereof.

What is claimed is:

1. An apparatus for chemical mechanical polishing of semiconductor wafers, comprising:

a platform for mounting semiconductor wafers said platform thereby forming a wafer carrier table;

a means for rotating said platform for mounting semiconductor wafers;

a first and second platform for mounting semiconductor wafer polishing pads whereby said platforms are two identical wafer polishing tables said platforms thereby forming first and second wafer polishing tables whereby the second of said two wafer polishing tables rotates at a rotational speed that is essentially a sum of a rotational speed of said wafer carrier table and a rotational speed of said first wafer polishing table;

a means for rotating said platforms for mounting said semiconductor wafer polishing pads; and a means for evenly distributing slurry across a surface of said polishing pads.

2. The apparatus of claim 1 wherein said wafer carrier table when in operational status is mounted in a position that is fixed with respect to said wafer polishing table wherein said mounting of said wafer carrier table is such that a center of an axis that drives a rotational motion of said wafer carrier table is located in a geometric center of and in a plane of two centers of said axis that drive said platforms for mounting semiconductor wafer polishing pads.

3. The apparatus of claim 1 wherein said platform for mounting semiconductor wafers is mounted in a position that is movable in an oscillating motion with respect to said first and second platforms for mounting semiconductor wafer polishing pads said movement to be such that a center of an axis that drives a rotational motion of said wafer carrier table remains in between and within a plane of two centers of axis that drive said first and second wafer polishing platforms.

4. The apparatus of claim 1 wherein axis of shafts that serve to mount said wafer carrier and said polishing platforms are parallel and fall within one plane.

5. The apparatus of claim 1 wherein said first and second platforms for mounting semiconductor wafer polishing pads are two identical wafer polishing tables whereby each polishing table is mounted in a fixed position within said polishing apparatus.

6. The apparatus of claim 1 whereby said wafer polishing pads within said wafer polishing tables are mounted in an upward position said position mating with and facing said semiconductor surfaces.

7. The apparatus of claim 1 wherein a direction of rotation of said first wafer polishing table is the same as said direction of rotation of said wafer carrier table.

8. The apparatus of claim 1 whereby a direction of rotation of said second wafer polishing table is a direction that is opposite to said direction of rotation of said wafer carrier.

9. The apparatus of claim 1 wherein said means for rotating said first and second wafer polishing platforms for mounting said semiconductor wafer polishing pads comprises rotary actuators or motors.

10. The apparatus of claim 1 whereby furthermore providing means to exert downward pressure on the wafer carrier thereby further enhancing polishing action provided by said polishing pads.

11. A method for chemical mechanical polishing of semiconductor wafers, said method to comprise:

providing a semiconductor wafer;

providing a platform for mounting said semiconductor wafer said platform forming a wafer carrier table;

providing a means for rotating said platform for mounting said semiconductor wafer;

providing a first and second platform for mounting semiconductor wafer polishing pads said platforms forming first and second wafer polishing tables whereby the second of said two polishing tables rotates at a rotational speed that is essentially a sum of twice a rotational speed of said wafer carrier and a rotational speed of said first polishing table;

providing a means for rotating said first and second platforms for mounting semiconductor wafer polishing pads; and providing a means for evenly distributing slurry across a surface of said polishing pads.

12. The method of claim 11 wherein said providing a platform for mounting said semiconductor wafer is providing a wafer carrier table whereby said wafer carrier table when in operational status is mounted in a position that is fixed with respect to said first and second wafer polishing tables.

13. The method of claim 11 wherein said mounting of said wafer carrier table is such that a center of an axis that drives a rotational motion of said wafer carrier table is located in a geometric center of and in a plane of two centers of said axis that drive said first and second wafer polishing tables.

14. The method of claim 11 wherein said wafer carrier table is mounted in a position that is movable in an oscillating motion with respect to said first and second wafer polishing tables said movement to be such that a center of an axis that drives a rotational motion of said wafer carrier remains in between and within a plane of two centers of axis that drive said first and second wafer polishing tables.

15. The method of claim 11 wherein axis of shafts that serve to mount said wafer carrier and said first and second wafer polishing platforms are parallel and fall within one plane.

16. The method of claim 11 wherein said providing a first and second platform for mounting semiconductor wafer polishing pads is providing two identical polishing tables whereby each polishing table is mounted in a fixed position within said polishing apparatus whereby polishing pads within said first and second polishing tables are mounted in an upward position said position mating with and facing said semiconductor surface.

17. The method of claim 11 wherein a direction of rotation of said first polishing table is the same as said direction of rotation of said wafer carrier.

18. The method of claim 11 whereby a direction of rotation of said second polishing table is a direction that is opposite to said direction of rotation of said wafer carrier.

19. The method of claim 11 wherein providing a means for rotating said first and second platform for mounting said semiconductor wafer polishing pads comprises rotary actuators or motors.

20. The method of claim 11 whereby furthermore providing a means to exert downward pressure on said wafer carrier table thereby further enhancing a polishing action provided by said polishing pads.

21. An apparatus for chemical mechanical polishing of a multiplicity of semiconductor wafers, comprising:

a multiplicity of platforms for mounting semiconductor wafers;

a means for rotating said multiplicity of platforms for mounting semiconductor wafers;

a multiplicity of platforms for mounting semiconductor wafer polishing pads wherein said multiplicity of polishing platforms is divided into two groups in accordance with either a clock-wise or counter-clock wise rotational direction of said polishing platforms whereby a number of polishing platforms contained within each group is essentially the same whereby polishing platforms that are mounted in adjacent positions within a polishing apparatus belong to one or the other but not to the same group;

a means for rotating said multiplicity of platforms for mounting said semiconductor wafer polishing pads whereby a speed of rotation of a group of polishing platforms that rotate in an opposite rotational direction as said multiplicity of wafer carrier tables is equal to a rotational speed of said multiplicity of wafer carrier tables plus a rotational speed of a multiplicity of polishing platforms that rotate in a same direction as said multiplicity of wafer carrier tables; and a means for evenly distributing slurry across a surface of said multiplicity of polishing pads.

22. The apparatus of claim 21 wherein said multiplicity of platforms for mounting semiconductor wafers is a multiplicity of wafer carrier tables whereby said multiplicity of wafer carrier tables when in operational status is mounted in a position that is fixed with respect to said multiplicity of wafer polishing pads.

23. The apparatus of claim 21 wherein said mounting of said multiplicity of wafer carrier platforms is such that centers of a multiplicity of axis that drive a rotational motion of said multiplicity of wafer carrier platforms is located in a plane of centers of a multiplicity of axis that drive said multiplicity of polishing pads.

24. The apparatus of claim 21 wherein said multiplicity of platforms for mounting semiconductor wafers is mounted in a position that is movable in an oscillating motion with respect to said multiplicity of polishing tables said movement to be such that a center of an axis that drives a rotational motion of said multiplicity of wafer carriers remains in a plane of centers of axis that drive said multiplicity of polishing tables.

25. The apparatus of claim 21 wherein said means for rotating said multiplicity of platforms for mounting semiconductor wafers is a multiplicity of rotary actuators or motors.

26. The apparatus of claim 21 wherein axis of shafts that serve to mount said multiplicity of wafer carriers and said multiplicity of polishing platforms are parallel and fall within one plane.

27. The apparatus of claim 21 wherein said platforms for mounting said multiplicity of semiconductor wafer polishing pads contain identical polishing tables whereby each polishing table is mounted in a fixed position within said polishing apparatus.

28. The apparatus of claim 21 whereby a multiplicity of polishing pads within said multiplicity of polishing tables is mounted in an upward position said position mating with and facing said multiplicity of semiconductor wafers.

29. The apparatus of claim 21 wherein means for rotating said multiplicity of platforms for mounting said semiconductor wafer polishing pads comprises a multiplicity of rotary actuators or motors.

30. The apparatus of claim 21 whereby furthermore providing a means to exert downward pressure on said multiplicity of substrate carriers thereby further enhancing polishing action provided by said polishing pads.

31. A method for chemical mechanical polishing of semiconductor wafers, said method to comprise:

providing a multiplicity of semiconductor wafers;

providing a multiplicity of platforms for mounting semiconductor wafers;

providing a means for rotating said multiplicity of platform for mounting semiconductor wafers;

providing multiplicity of platforms for mounting semiconductor wafer polishing pads wherein said multiplicity of polishing platforms is divided into two groups in accordance with either a clock-wise or counter-clock wise rotational direction of said polishing platforms whereby a number of polishing platforms contained within each group is essentially the same whereby polishing platforms that are mounted in adjacent positions within a polishing apparatus belong to one or another but not to a same group;

providing a means for rotating said multiplicity of platforms for mounting said semiconductor wafer polishing pads whereby a speed of rotation of a group of polishing platforms that rotate in the opposite rotational direction as said multiplicity of wafer carrier tables is equal to twice a rotational speed of said multiplicity of wafer carrier tables plus a rotational speed of a multiplicity of polishing platforms that rotate in a same direction as said multiplicity of wafer carrier tables; and providing a means for evenly distributing slurry across a surface of said multiplicity of polishing pads.

32. The method of claim 31 wherein said providing a multiplicity of platforms for mounting semiconductor wafers is providing a multiplicity of wafer carrier tables whereby said multiplicity of wafer carriers table when in operational status is mounted in a position that is fixed with respect to said multiplicity of polishing tables.

33. The method of claim 31 wherein said mounting of said multiplicity of wafer carrier tables is such that centers of axis that drives a rotational motion of said multiplicity of wafer carrier tables is located in a plane of a multiplicity of centers of axis that drive said multiplicity of polishing tables.

34. The method of claim 31 wherein said multiplicity of wafer carrier tables is mounted in a position that is movable in an oscillating motion with respect to said multiplicity of polishing tables said movement to be such that a multiplicity of centers of axis that drive a rotational motion of said multiplicity of wafer carriers remains within a plane of a multiplicity of centers of axis that drive said multiplicity of wafer polishing tables.

35. The method of claim 31 wherein said providing a means for rotating said multiplicity of platforms for mounting semiconductor wafers is providing a multiplicity of rotary actuators or motors.

36. The method of claim 31 wherein axis of a multiplicity of shafts that serve to mount said multiplicity of wafer carriers and said multiplicity of polishing platforms are parallel and fall within one plane.

37. The method of claim 31 wherein said providing said multiplicity of platforms for mounting semiconductor wafer polishing pads is providing a multiplicity of identical polishing tables whereby said multiplicity of polishing tables is mounted in a fixed position within said polishing apparatus.

38. The method of claim 31 whereby said multiplicity of polishing pads within said multiplicity of polishing tables is mounted in an upward position said position mating with and facing said multiplicity of semiconductor surfaces.

39. The method of claim 31 wherein providing means for rotating said multiplicity of platforms for mounting said multiplicity of semiconductor wafer polishing pads comprises a multiplicity of rotary actuators or motors.

40. The method of claim 31 whereby furthermore providing means to exert downward pressure on a multiplicity of wafer carriers thereby further enhancing polishing action provided by said polishing pads.

* * * * *